US011724307B2

(12) United States Patent
Masuda et al.

(10) Patent No.: US 11,724,307 B2
(45) Date of Patent: Aug. 15, 2023

(54) DEVICE FOR ESTIMATING SOLIDIFIED SHELL THICKNESS IN MOLD, AND METHOD FOR ESTIMATING SOLIDIFIED SHELL THICKNESS IN MOLD

(71) Applicant: JFE STEEL CORPORATION, Tokyo (JP)

(72) Inventors: Ryosuke Masuda, Tokyo (JP); Yoshinari Hashimoto, Tokyo (JP); Akitoshi Matsui, Tokyo (JP); Shugo Morita, Tokyo (JP); Tatsuro Hayashida, Tokyo (JP); Taiga Koriyama, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 93 days.

(21) Appl. No.: 17/440,150

(22) PCT Filed: Mar. 3, 2020

(86) PCT No.: PCT/JP2020/008831
§ 371 (c)(1),
(2) Date: Sep. 16, 2021

(87) PCT Pub. No.: WO2020/195599
PCT Pub. Date: Oct. 1, 2020

(65) Prior Publication Data

US 2022/0152695 A1 May 19, 2022

(30) Foreign Application Priority Data

Mar. 22, 2019 (JP) ..... 2019-054078

(51) Int. Cl.
*B22D 11/18* (2006.01)

(52) U.S. Cl.
CPC ..... *B22D 11/188* (2013.01); *B22D 11/182* (2013.01)

(58) Field of Classification Search
CPC ..... B22D 11/16; B22D 46/00; B22D 11/18; B22D 11/182; B22D 11/188
(Continued)

(56) References Cited

U.S. PATENT DOCUMENTS

2008/0264598 A1 10/2008 Morales et al.
2015/0343530 A1 12/2015 Duncan et al.
(Continued)

FOREIGN PATENT DOCUMENTS

CN 102773443 A 11/2012
CN 104384469 A 3/2015
(Continued)

OTHER PUBLICATIONS

Machine translation of CN 102773443 A (Year: 2012).*
(Continued)

*Primary Examiner* — Kevin P Kerns
(74) *Attorney, Agent, or Firm* — Oliff PLC

(57) ABSTRACT

A device includes: an input device configured to receive an input of measurement results of a temperature and components of molten steel in a tundish of continuous casting facilities, measurement results of a width, a thickness, and a casting speed of a cast slab casted in the continuous casting facilities, and molten steel flow rate distribution in a mold; a model database configured to store a model expression and a parameter related to solidification reaction of molten steel in the mold; a convertor configured to convert a molten steel flow rate in the mold into a heat conductivity parameter; and a calculator configured to estimate a solidified shell thickness in the mold based on temperature distribution of the mold and steel in the mold calculated by solving a three-
(Continued)

dimensional transient heat conduction equation using the measurement results.

16 Claims, 8 Drawing Sheets

(58) Field of Classification Search
USPC ..... 164/451, 452, 453, 449.1, 154.4, 154.5, 164/154.7
See application file for complete search history.

(56) References Cited

U.S. PATENT DOCUMENTS

| | | | |
|---|---|---|---|
| 2016/0332221 | A1 | 11/2016 | Kosugi et al. |
| 2019/0193146 | A1 | 6/2019 | Kosugi et al. |

FOREIGN PATENT DOCUMENTS

| | | | |
|---|---|---|---|
| CN | 106238695 | A | 12/2016 |
| CN | 106413942 | A | 2/2017 |
| JP | 2011-079023 | A | 4/2011 |
| JP | 2016-016414 | A | 2/2016 |
| JP | 2016-175114 | A | 10/2016 |
| SU | 959908 | A1 | 9/1982 |
| SU | 1006049 | A1 | 3/1983 |
| WO | 2009/107865 | A1 | 9/2009 |
| WO | 2015/115651 | A1 | 8/2015 |

OTHER PUBLICATIONS

Jun. 30, 2022 Office Action issued in Russian Patent Application No. 2021127481.
Jul. 28, 2022 Office Action issued in Chinese Patent Application No. 202080021898.4.
Dec. 15, 2021 Extended Search Report issued in European Patent Application No. 20776409.3.
Watanabe et al., "Density of Pure Iron in Solid and Liquid States," Journal Japan Institute of Metals and Materials, 1981, vol. 45, No. 3, pp. 242-249.
Dec. 28, 2020 Office Action issued in Taiwanese Patent Application No. 109108881.
Apr. 7, 2020 International Search Report issued in International Patent Application No. PCT/JP2020/008831.

* cited by examiner

DEVICE FOR ESTIMATING SOLIDIFIED SHELL THICKNESS IN MOLD, AND METHOD FOR ESTIMATING SOLIDIFIED SHELL THICKNESS IN MOLD

FIELD

The present invention relates to a device for estimating a solidified shell thickness in a mold and a method for estimating a solidified shell thickness in a mold.

BACKGROUND

In a continuous casting machine, molten steel is continuously injected from a tundish, cooled by a mold in which a water-cooled pipe is embedded, and drawn out from the lower part of the mold. In the continuous casting process, the improvement in productivity by high-speed casting has been demanded more and more. However, the increase in casting speed reduces a solidified shell thickness of a cast slab at a mold lower end part, or causes ununiform distribution in solidified shell thickness. Consequently, when a region with a thin solidified shell thickness comes to an outlet of a mold, there may be occurred a so-called breakout in which the solidified shell is broken and the molten steel is leaked. If the breakout occurs, the operation stops for a long time, which considerably deteriorates the productivity. Therefore, there has been demanded the development of a method capable of accurately predicting a danger of breakout while performing high-speed casting, and various methods have been proposed. For example, Patent literature 1 describes a method in which a solidified shell thickness at a given position from a molten metal surface toward an output of a mold is estimated based on a heat flux profile until the molten steel reaches the outlet of the mold from the molten metal surface and, based on this, a solidified shell thickness at the outlet of the mold is predicted.

CITATION LIST

Patent Literature

Patent Literature 1: Japanese Patent Application Laid-open No. 2011-79023

Patent Literature 2: Japanese Patent Application Laid-open No. 2016-16414

Non Patent Literature

Non Patent Literature 1: Materials Transactions Vol. 45 (1981), No. 3, p. 242

SUMMARY

Technical Problem

However, the method described in Patent Literature 1 considers heat input to a solidification interface by the flow of molten steel in a mold only in the normal state. Therefore, in the method described in Patent Literature 1, it is considered that with a deviation of sensible heat due to a transient change of the flow of molten steel, an estimated value of a solidified shell thickness may be varied. Moreover, in the method described in Patent Literature 1, the heat transfer calculation is performed in one dimension, and only the distribution in the height direction of a solidified shell thickness is estimated. However, even when the height position is the same, the solidified shell thickness actually varies in the width direction and the thickness direction of a mold. Thus, with the method described in Patent Literature 1, it is not possible to predict local thinning of a solidified shell in the width direction and the thickness direction of the mold.

In view of the above-described problem, the present invention aims at providing a device for estimating a solidified shell thickness in a mold and a method for estimating a solidified shell thickness in a mold that are capable of estimating, with high accuracy, a solidified shell thickness in a mold including the width direction and the thickness direction of the mold.

Solution to Problem

A device for estimating a solidified shell thickness in a mold according to the present invention includes: an input device configured to receive an input of measurement results of a temperature and components of molten steel in a tundish of continuous casting facilities, measurement results of a width, a thickness, and a casting speed of a cast slab casted in the continuous casting facilities, and molten steel flow rate distribution in a mold; a model database configured to store a model expression and a parameter related to solidification reaction of molten steel in the mold of the continuous casting facilities; a convertor configured to convert a molten steel flow rate in the mold input to the input device into a heat conductivity parameter; and a heat transfer model calculator configured to estimate a solidified shell thickness in the mold based on temperature distribution of the mold and steel in the mold calculated by solving a three-dimensional transient heat conduction equation using the measurement results of a temperature and components of molten steel in the tundish of the continuous casting facilities, the measurement results of a width, a thickness, and a casting speed of a cast slab casted in the continuous casting facilities, the model expression, the parameter, and the heat conductivity parameter calculated by the convertor.

In the above-described device for estimating a solidified shell thickness in a mold according to the present invention, the convertor is configured to convert a molten steel flow rate in a region having a temperature higher than a solidus temperature of molten steel and lower than a liquidus temperature of molten steel into a heat conductivity parameter.

In the above-described device for estimating a solidified shell thickness in a mold according to the present invention, the heat transfer model calculator is configured to calculate a solidification shrinkage amount of molten steel based on temperature distribution of steel in the mold, and calculate a general heat transfer coefficient between the mold and the solidified shell based on the solidification shrinkage amount.

In the above-described device for estimating a solidified shell thickness in a mold according to the present invention, the heat transfer model calculator is configured to perform three-dimensional transient heat transfer calculation by vertically arranging two-dimensional transient heat transfer calculation models divided in a height direction of the mold.

A method for estimating a solidified shell thickness in a mold according to the present invention includes: an input step of inputting measurement results of a temperature and components of molten steel in a tundish of continuous casting facilities, measurement results of a width, a thickness, and a casting speed of a cast slab casted in the continuous casting facilities, and molten steel flow rate distribution in a mold; a conversion step of converting a molten steel flow rate in the mold input at the input step into a heat conductivity parameter; and a heat transfer model calculation step of estimating a solidified shell thickness in the mold based on temperature distribution of the mold and steel in the mold calculated by solving a three-dimensional transient heat conduction equation using the measurement results of a temperature and components of molten steel in the tundish of the continuous casting facilities, the measurement results of a width, a thickness, and a casting speed of a cast slab casted in the continuous casting facilities, a model expression and a parameter related to solidification reaction of the molten steel in the mold of the continuous casting facilities, and the heat conductivity parameter calculated at the conversion step.

In the above-described method for estimating a solidified shell thickness in a mold according to the present invention, the conversion step includes a step of converting a molten steel flow rate in a region having a temperature higher than a solidus temperature of molten steel and lower than a liquidus temperature of molten steel into a heat conductivity parameter.

In the above-described method for estimating a solidified shell thickness in a mold according to the present invention, the heat transfer model calculation step includes a step of calculating a solidification shrinkage amount of molten steel based on temperature distribution of steel in the mold, and calculating a general heat transfer coefficient between the mold and the solidified shell based on the solidification shrinkage amount.

In the above-described method for estimating a solidified shell thickness in a mold according to the present invention, the heat transfer model calculation step includes a step of performing three-dimensional transient heat transfer calculation by vertically arranging two-dimensional transient heat transfer calculation models divided in a height direction of the mold.

Advantageous Effects of Invention

With the device for estimating a solidified shell thickness in a mold and the method for estimating a solidified shell thickness in a mold according to the present invention, it is possible to estimate, with high accuracy, a solidified shell thickness in a mold including the width direction and the thickness direction of the mold.

DESCRIPTION OF EMBODIMENTS

The following will specifically describe the configuration of a device for estimating a solidified shell thickness in a mold according to an embodiment of the present invention and the actions thereof with reference to the enclosed drawings.

[Configuration of a Device for Estimating a Solidified Shell Thickness in a Mold]

First, the configuration of a device for estimating a solidified shell thickness in a mold according to an embodiment of the present invention will be described with reference to FIG. 1.

Figure 1:
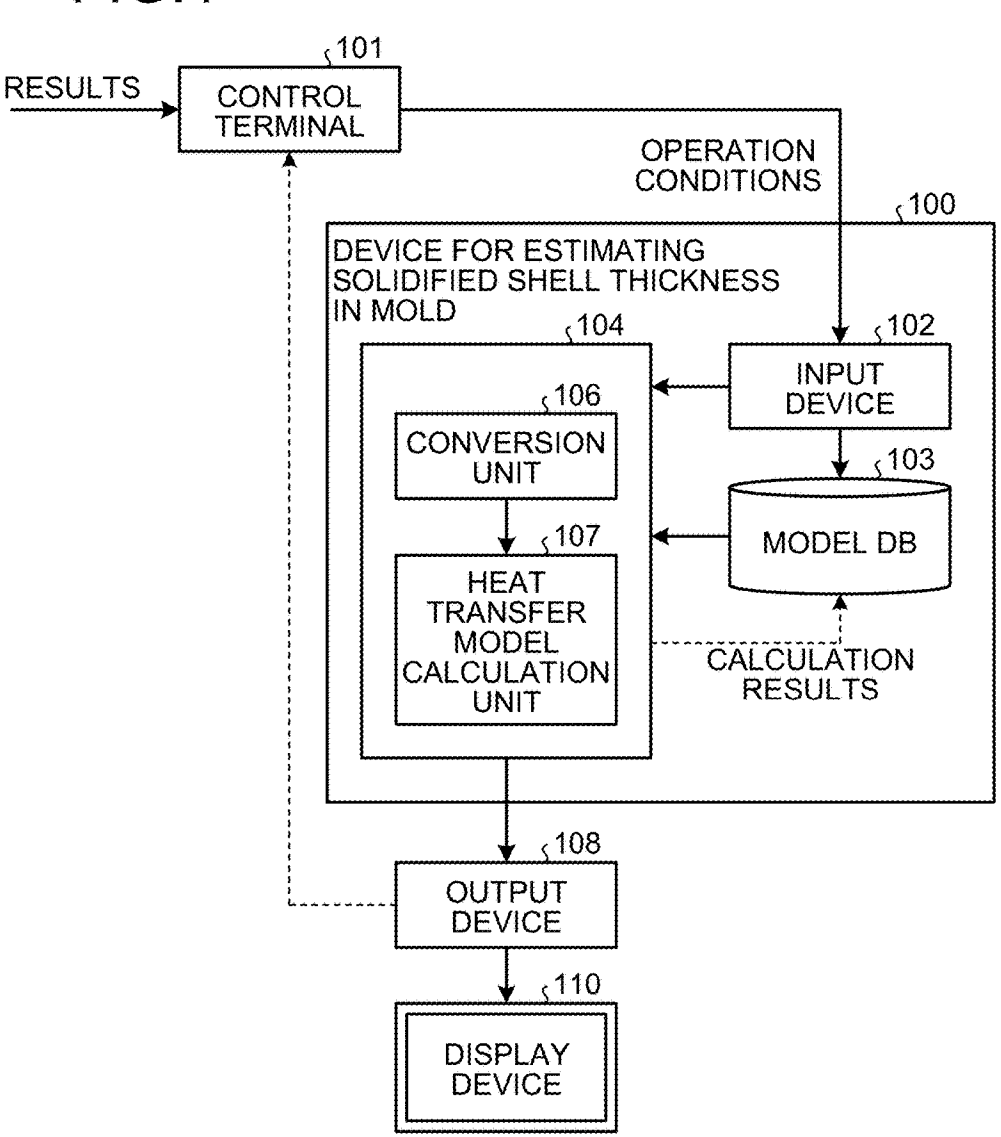
FIG. 1 is a schematic view illustrating a configuration of a device for estimating a solidified shell thickness in a mold according to an embodiment of the present invention.
Figure 1:
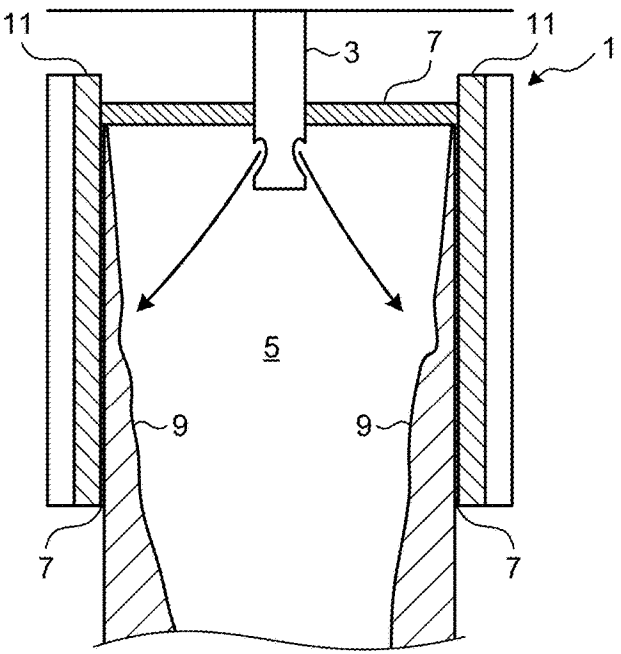

FIG. 1 is a schematic view illustrating a configuration of a device for estimating a solidified shell thickness in a mold according to an embodiment of the present invention. As illustrated in FIG. 1, a device 100 for estimating a solidified shell thickness in a mold according to an embodiment of the present invention is a device for estimating a thickness of a solidified shell 9 (a solidified shell thickness in a mold) formed by solidification of molten steel 5 in a mold 1 in continuous casting facilities in the steel industry. The result information (measurement results) of an immersion depth of an immersion nozzle 3 in the continuous casting facilities and a casting speed (a pouring speed), an interval between casting copper plates 11 corresponding to the width and the thickness of a cast slab casted in the continuous casting facilities, and the components and a temperature of the molten steel 5 in a tundish of the continuous casting facilities, is transmitted to a control terminal 101. Note that the reference sign 7 in FIG. 1 illustrates mold powder.

A control system to which the device 100 for estimating a solidified shell thickness in a mold and the method for estimating a solidified shell thickness in a mold are applied, includes the control terminal 101, the device 100 for estimating a solidified shell thickness in a mold, an output device 108, and a display device 110, as main components. The control terminal 101 is formed by an information processing device such as a personal computer or a workstation, and collects various kinds of result information, solidified shell thickness distribution in a mold, a temperature of the copper plate 11, and an estimation value of a mold heat reduction amount.

The device 100 for estimating a solidified shell thickness in a mold is formed by an information processing device such as a personal computer or a workstation. The device 100 for estimating a solidified shell thickness in a mold includes an input device 102, a model database (model DB) 103, and an arithmetic processing unit 104.

The input device 102 is an interface for input to which various kinds of result information related to continuous casting facilities are input. The input device 102 is a keyboard, a mouse, a pointing device, a data reception device, a graphical user interface (GUI), and the like. The input device 102 receives result information, a parameter setting value, and the like from the outside, and writes the information into the model DB 103 or transmits the information to the arithmetic processing unit 104. The result information is input to the input device 102 from the control terminal 101. The result information includes an immersion depth of the immersion nozzle 3 and a casting speed, an interval between the mold copper plates 11 corresponding to the width and the thickness of a cast slab to be casted, and components information and temperature information or the like of the molten steel 5.

The model DB 103 is a storage device that stores information of model expressions related to solidification reaction of the molten steel 5 in continuous casting facilities. The model DB 103 stores parameters of model expressions as the information of model expressions related to solidification reaction of the molten steel 5. Moreover, the model DB 103 stores various kinds of information input to the input device 102, and calculation results in actual operation results calculated by the arithmetic processing unit 104.

The arithmetic processing unit 104 is formed by an arithmetic processing device such as a central processing unit (CPU), and controls the entire actions of the device 100 for estimating a solidified shell thickness in a mold. The arithmetic processing unit 104 has functions as a conversion unit 106 and a heat transfer model calculation unit 107. The conversion unit 106 and the heat transfer model calculation unit 107 are achieved when the arithmetic processing unit 104 executes a computer program, for example. The arithmetic processing unit 104 functions as the conversion unit 106 by executing a computer program for the conversion unit 106, and functions as the heat transfer model calculation unit 107 by executing a computer program for the heat transfer model calculation unit 107. Note that the arithmetic processing unit 104 may include a dedicated arithmetic device or arithmetic circuit functioning as the conversion unit 106 and the heat transfer model calculation unit 107.

On the basis of the model information and the actual operation result information stored in the model DB 103, the conversion unit 106 converts an absolute value of a normal line component for the mold copper plate 11 in the molten steel flow rate in the mold 1, into a heat conductivity of a semi-solidified region existing between the molten steel 5 and the solidified shell 9.

On the basis of the calculation result by the conversion unit 106 and the actual operation result information, and the model information stored in the model DB 103, the heat transfer model calculation unit 107 solves a three-dimensional transient heat conduction equation so as to estimate the temperature distribution of the mold copper plate 11 and the inside of the mold 1, a mold heat reduction amount, and the solidified shell thickness distribution in a mold.

The output device 108 outputs various kinds of processing information of the device 100 for estimating a solidified shell thickness in a mold to the control terminal 101 and the display device 110. The display device 110 displays and outputs various kinds of information of the device 100 for estimating a solidified shell thickness in a mold output from the output device 108.

The device 100 for estimating a solidified shell thickness in a mold having such a configuration performs the following processing for estimating a solidified shell thickness in a mold so as to estimate the solidified shell thickness distribution in the mold 1 including the width direction and the thickness direction of the mold 1.

[Conversion of Molten Steel Flow Rate and Semi-Solidified Region Heat Conductivity]

In order to estimate, with high accuracy, the change with time of three-dimensional distribution of a solidified shell thickness in a mold, it is important to consider the change with time of a local heat flux caused by a transient change of a molten steel flow. For this, it is necessary to couple and solve the three-dimensional transient flow calculation related to a molten steel flow and the three-dimensional transient heat transfer calculation related to solidification of the molten steel 5. However, the above-described coupling calculation is poor in convergence, and has a problem of long calculation time. Therefore, in the present invention, the molten steel flow rate distribution in the mold 1 is converted into a heat conductivity of a semi-solidified region based on a preliminarily formed conversion expression, thereby calculating the distribution of a solidified shell thickness in a mold in the single unit of three-dimensional transient heat transfer model. The semi-solidified region is a region in a process of solidification between a liquid phase of the molten steel 5 and the solidified shell 9. With the semi-solidified region, it is not possible to precisely define the interface between the solidified shell 9 and the molten steel 5 in a physical calculation model. Therefore, it is difficult to consider heat transfer on the interface between the molten steel 5 and the solidified shell 9 directly in the physical calculation model. Thus, in the present invention, not a heat transfer coefficient of the solidification interface but a heat conductivity of a semi-solidified region has the dependency of a molten steel flow rate.

Figure 2:
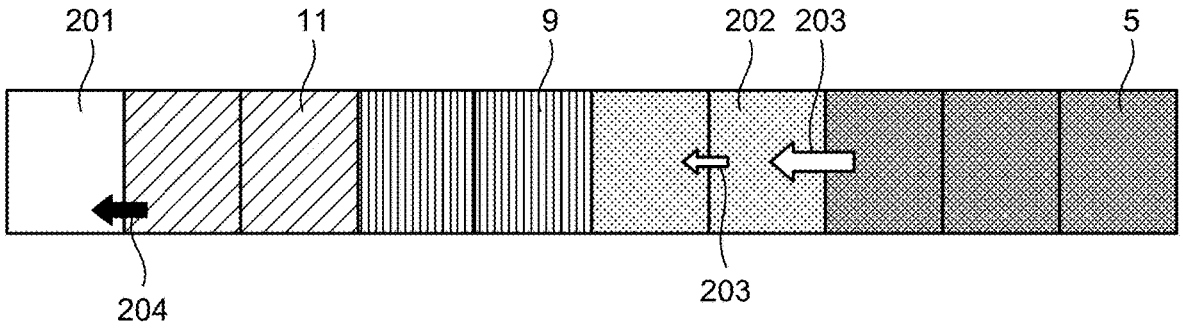
FIG. 2 is a schematic view illustrating a configuration example of a one-dimensional transient heat transfer calculation model.

The following will describe a method of deriving a conversion expression of a molten steel flow rate and a semi-solidified region heat conductivity. The coupling calculation of the three-dimensional transient flow calculation related to a molten steel flow and the three-dimensional transient heat transfer calculation related to the solidification of the molten steel 5 is difficult, while one-dimensional transient flow calculation and one-dimensional transient heat transfer calculation converge preferably. Then, in the present invention, there was formed a one-dimensional transient heat transfer calculation model including a convection term illustrated in the schematic view of FIG. 2. As illustrated in FIG. 2, for simplification in the embodiment, calculation cells in both ends of the model were regarded as cooling water 201 of the mold copper plate 11 and the molten steel 5, and a cooling water temperature and a molten steel temperature were set to be constant. Moreover, a calculation cell in which the lattice point temperature is in a range from a solidus temperature $T_s$ to a liquidus temperature $T_L$ was considered as a semi-solidified region 202. A molten steel flow rate was reduced with the increase of a solid phase ratio in the semi-solidified region 202 so as to model the phenomenon of diffusion of an impinging flow (a discharge flow) to the sides on the solidified shell surface. The solid phase ratio in the semi-solidified region 202 was changed to be linear by setting the solid phase ratio of a calculation cell in which the temperature of steel is a solidus temperature $T_s$ to 1 and the solid phase ratio of a calculation cell in which the temperature of steel is a liquidus temperature $T_L$ to 0. Meanwhile, it is known that in the semi-solidified region 202, a molten steel flow rate is reduced sharply as the solid phase ratio is increased. Therefore, the relation between the temperature of steel and the molten steel flow rate in the semi-solidified region 202 was given exponentially. Note that the reference signs 203 and 204 in FIG. 2 illustrate a molten steel flow rate and a mold heat reduction amount, respectively. Then, the one-dimensional transient heat conduction equation including the convection term shown in the following Expression (1) is discretized to calculate a temperature of each calculation cell.

$$\rho\frac{\partial(C_PT)}{\partial t} = \frac{\partial}{\partial x}\left(k\frac{\partial T}{\partial x}\right) - \rho\frac{\partial(C_Put)}{\partial x} \quad (1)$$

Here, in Expression (1), ρ [kg/m$^3$] indicates a density, $C_p$ [J/kg·K)] a specific heat, k [W/(m·K)] a heat conductivity, T [K] a temperature, and u [m/s] a molten steel flow rate.

Figure 3:
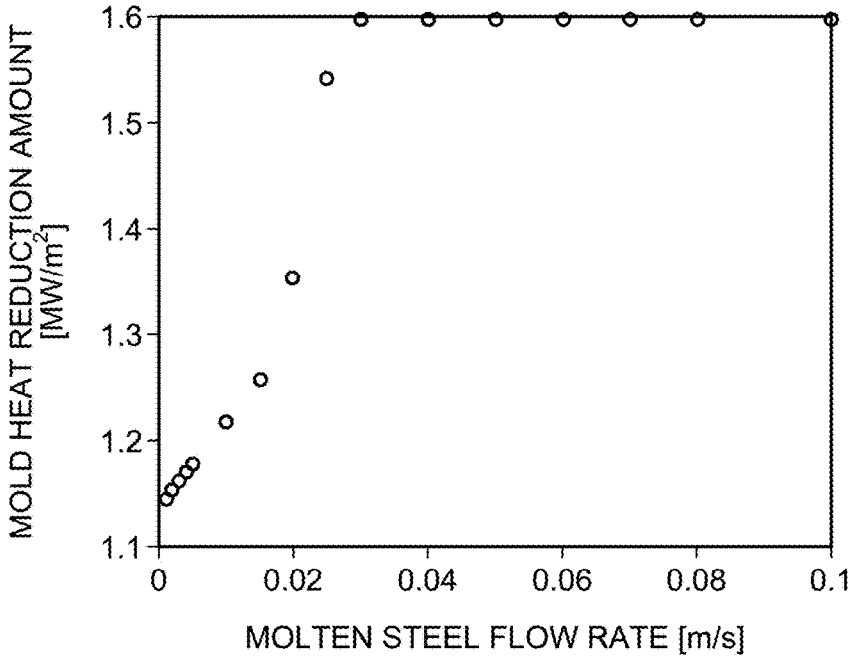
FIG. 3 is a diagram illustrating an example of the relation between the molten steel flow rate and the mold heat reduction amount.

The temperature of each calculation cell was calculated until the state becomes normal under the conditions shown in the following Table 1, and a thermal flux from the calculation cell of the solidified shell 9 to the calculation cell of the mold copper plate 11 was calculated as a mold heat reduction amount. FIG. 3 illustrates the relation between the molten steel flow rate and the calculation value of a mold heat reduction amount. As illustrated in FIG. 3, as the molten steel flow rate was increased, the calculation value of a mold heat reduction amount was increased monotonically. When the molten steel flow rate exceeds 0.03 [m/s], the mold heat reduction amount was saturated. It is considered that this is because the solidified shell 9 was not formed by the influence of a molten steel flow.

TABLE 1

| | | |
|---|---|---|
| Density of copper $C_{P,\ Cu}$ | 600 | J/(kg · K) |
| Heat conductivity of copper $k_{Cu}$ | 300 | W/(m · K) |
| Heat conductivity of molten steel $k_{Fe}$ | 30 | W/(m · K) |
| Density of molten steel $\rho_{Fe}$ | 7000 | kg/m$^3$ |
| Thickness of powder | 0.0006 | m |
| Thickness of mold copper plate | 0.03 | m |
| Heat conductivity of powder | 1.5 | W/(m · K) |
| Molten steel injection temperature | 1530 | ° C. |
| Liquidus temperature $T_L$ | 1530 | ° C. |
| Solidus temperature $T_S$ | 1500 | ° C. |
| Heat transfer coefficient of cooling water | 25000 | W/(m$^2$ · K) |
| Heat transfer coefficient of air | 2500 | W/(m$^2$ · K) |

Figure 4:
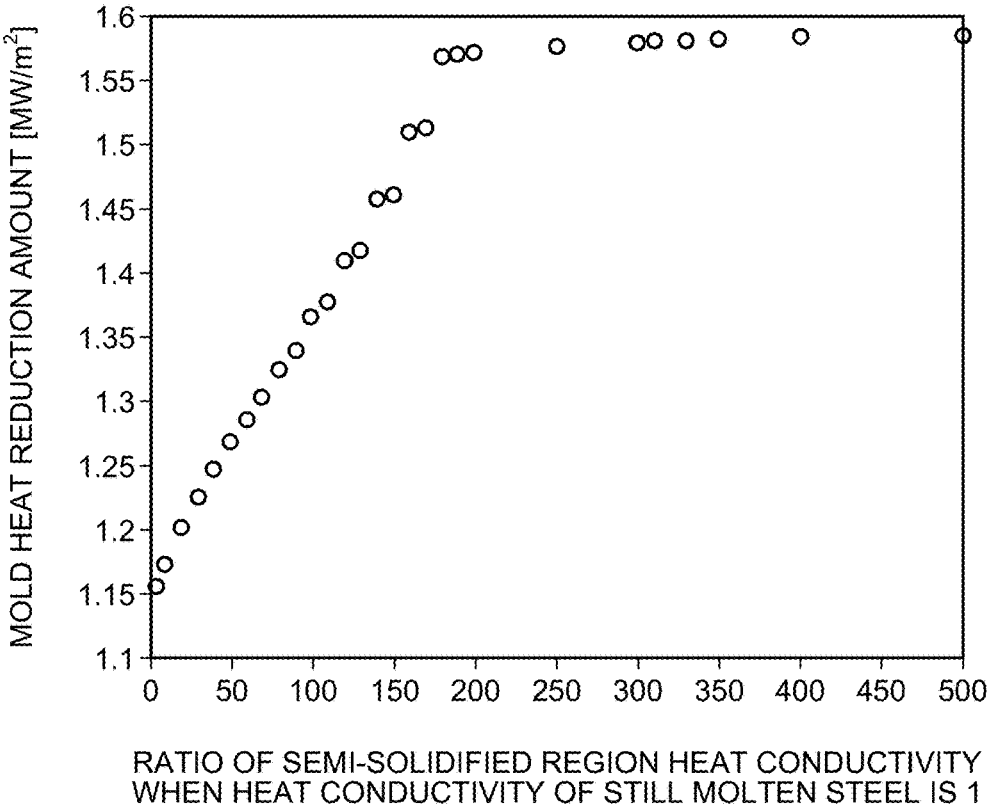
FIG. 4 is a diagram illustrating an example of the relation between the semi-solidified region heat conductivity and the mold heat reduction amount.
Figure 5:
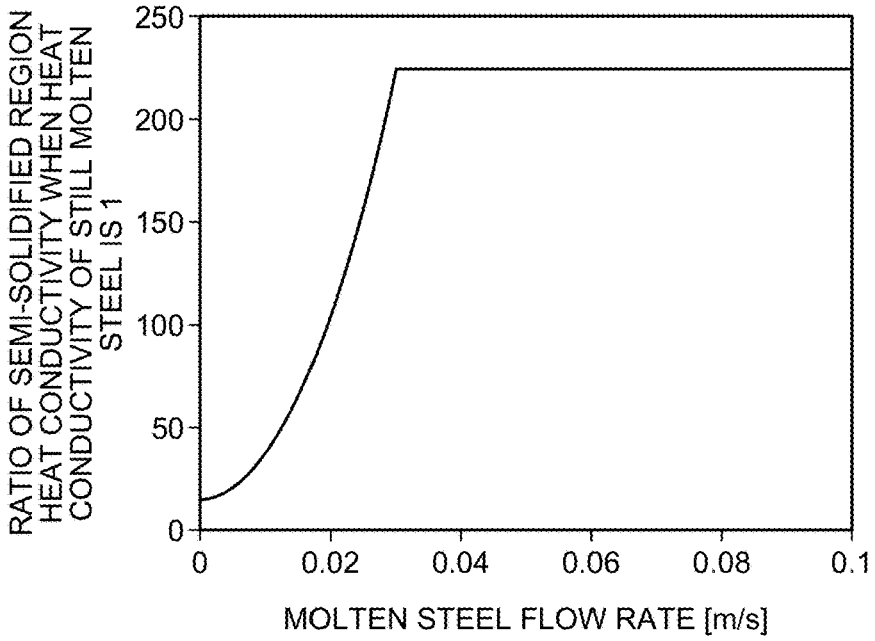
FIG. 5 is a diagram illustrating an example of the relation between the molten steel flow rate and the semi-solidified region heat conductivity.

Next, the molten steel flow rate was set to 0 [m/s] under the conditions shown in Table 1, and the heat conductivity of the semi-solidified region was changed. FIG. 4 illustrates the relation between the ratio of a semi-solidified region heat conductivity when the heat conductivity of still molten steel is 1 and the calculation value of a mold heat reduction amount. As illustrated in FIG. 4, when the semi-solidified region heat conductivity is large, sensible heat supplied to the semi-solidified region is increased, which increases a calculation value of a mold heat reduction amount. Then, there was searched a semi-solidified region heat conductivity in FIG. 4 to obtain a value equal to the mold heat reduction amount in each molten steel flow rate in FIG. 3, and there was obtained a conversion expression showing the relation between the molten steel flow rate and the semi-solidified region heat conductivity illustrated in FIG. 5. The obtained conversion expression is stored in the model DB 103 in FIG. 1, and used for three-dimensional transient heat transfer calculation. Note that although the method of converting a molten steel flow rate into a heat conductivity in a semi-solidified region has been described here, the molten steel flow rate may be also converted as a heat conductivity parameter including a specific heat and the like.

[Processing for Estimating a Solidified Shell Thickness in a Mold]

Figure 6:
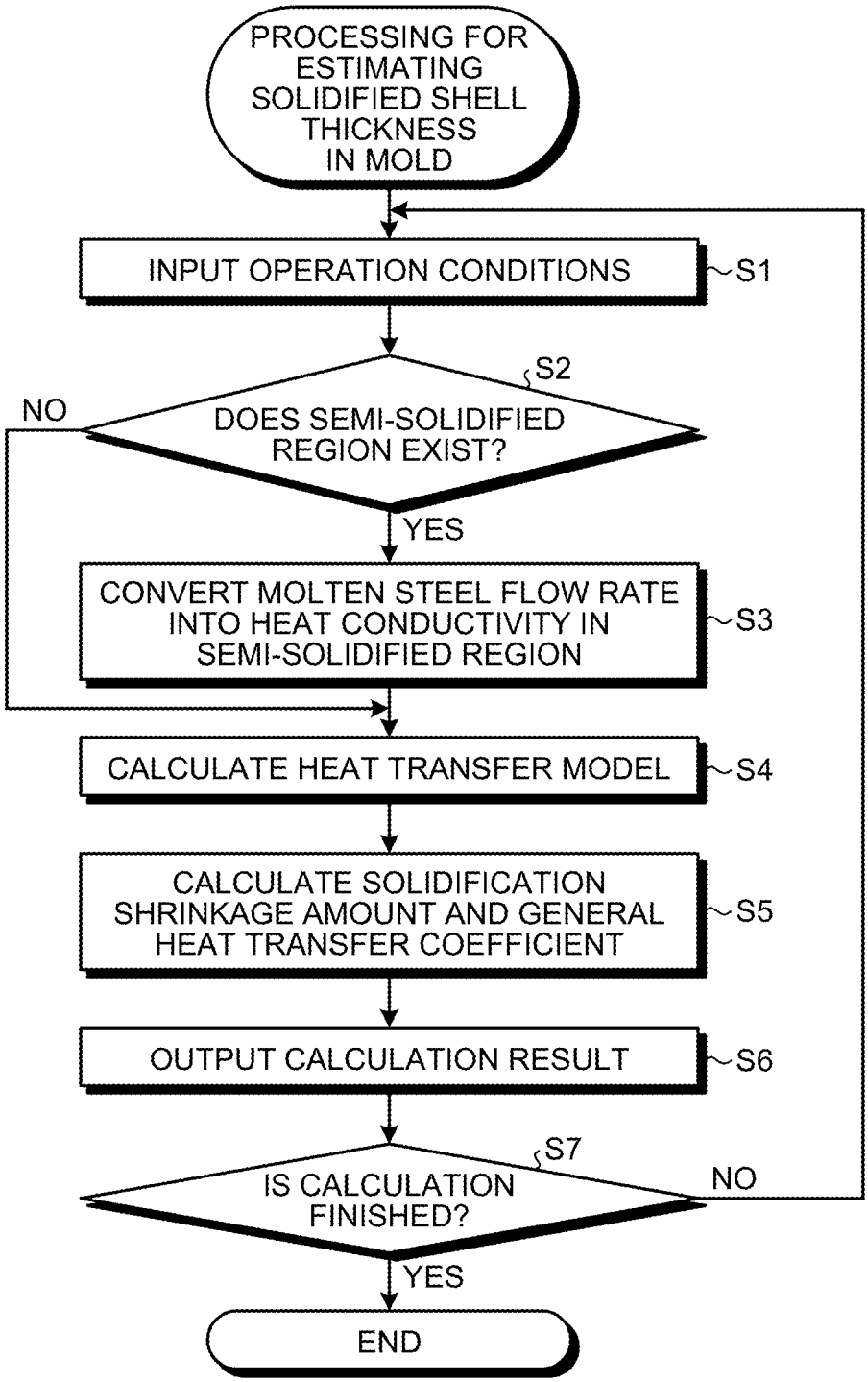
FIG. 6 is a flowchart illustrating a flow of processing for estimating a solidified shell thickness in a mold according to an embodiment of the present invention.

FIG. 6 is a flowchart illustrating a flow of processing for estimating a solidified shell thickness in a mold according to an embodiment of the present invention. The flowchart illustrated in FIG. 6 starts at timing when the casting is started, and the processing for estimating a solidified shell thickness in a mold shifts to the process of Step S1.

At the process of Step S1, the arithmetic processing unit 104 acquires a measurement value and an analysis value related to the molten steel 5 and the mold 1 from the control terminal 101. In the normal continuous casting operation, there is collected, in a fixed cycle, the result information of a casting speed and an interval between the mold copper plates 11 corresponding to the width and the thickness of a cast slab to be casted. For simplification in the embodiment, it is supposed that the result information related to the mold 1 is collected every second. Moreover, the result information of components of the molten steel 5 and a temperature is collected in the tundish irregularly or in a fixed cycle. Moreover, for the flow rate distribution of the molten steel 5 in the embodiment, there may be used flow rate calculation values of the molten steel 5 collected in a fixed cycle, or flow rate estimation values obtained by calculating a three-dimensional transient flow calculation model using the result information, as illustrated in Patent Literature 2, for example. Thus, the process of Step S1 is completed, and the processing for estimating a solidified shell thickness in a mold shifts to the process of Step S2.

At the process of Step S2, the conversion unit 106 determines whether a semi-solidified region exists in the mold 1 based on the information acquired at the process of Step S1. To be more specific, the conversion unit 106 determines whether there exists a region in which the temperature of the molten steel 5 is in a range from the solidus temperature $T_s$ to the liquidus temperature $T_L$, based on the temperature information of the molten steel 5 acquired at the process of Step S1, thereby determining whether a semi-solidified region exists in the mold 1. As a result of determination, when the semi-solidified region exists in the mold 1 (Yes at Step S2), the conversion unit 106 shifts the processing for estimating a solidified shell thickness in a mold to the process of Step S3. Meanwhile, when the semi-solidified region does not exist in the mold 1 (No at Step S2), the conversion unit 106 shifts the processing for estimating a solidified shell thickness in a mold to Step S4.

At the process of Step S3, the conversion unit 106 converts the molten steel flow rate of the semi-solidified region detected at the process of Step S2 into a heat conductivity, using the conversion expression of the molten steel flow rate and the semi-solidified region heat conductivity stored in the model DB 103. Thus, the process of Step S3 is completed, and the processing for estimating a solidified shell thickness in a mold shifts to the process of Step S4.

Figure 7:
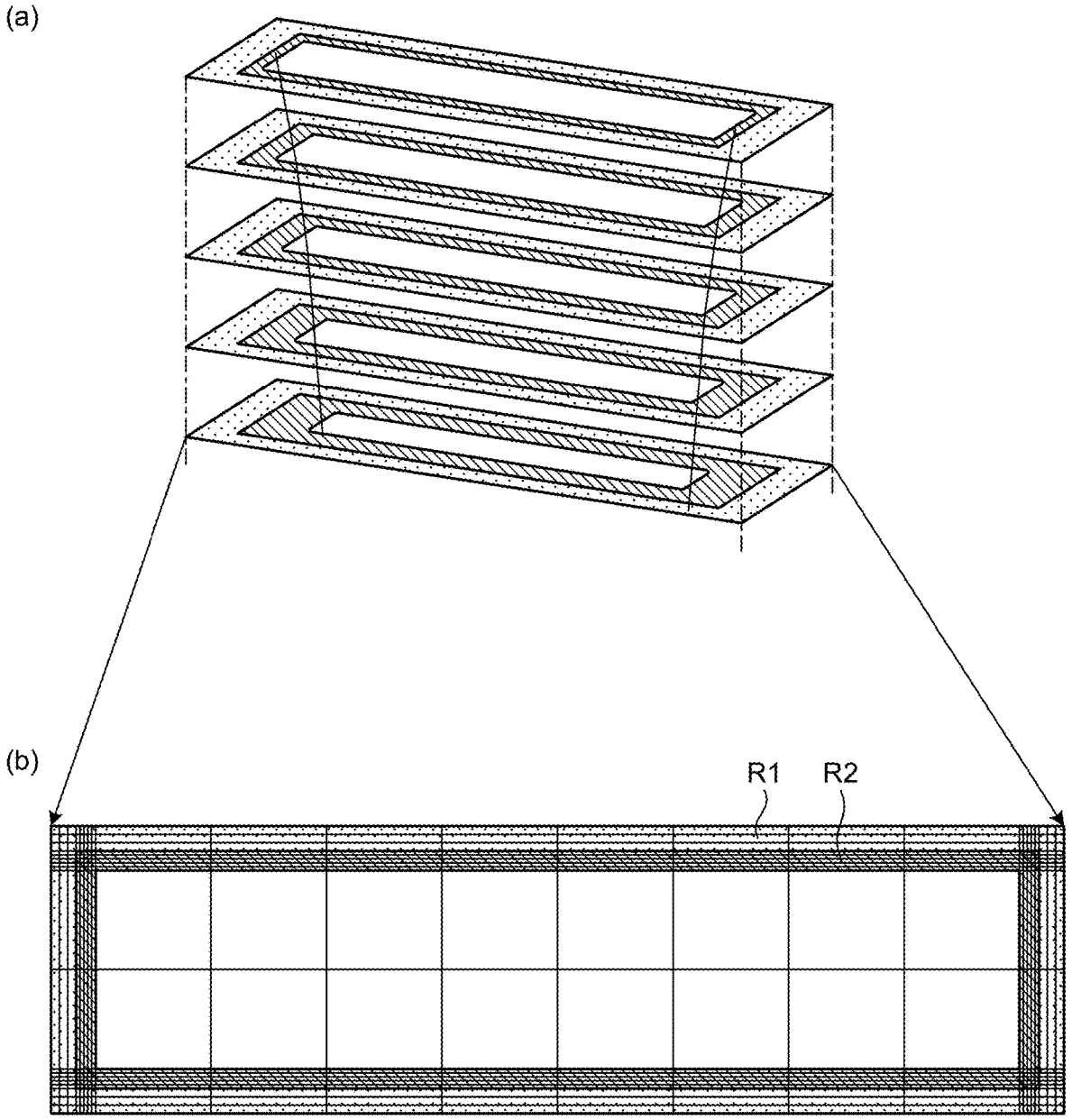
FIG. 7 is a schematic view illustrating a configuration example of a three-dimensional transient heat transfer calculation model.

At the process of Step S4, the heat transfer model calculation unit 107 performs three-dimensional transient heat transfer calculation using the information acquired at the process of Step S1 and the Step S3 and the information of the model DB 103. FIG. 7 illustrates an example of the constructed three-dimensional transient heat transfer calculation model. The region R1 in FIG. 7 illustrates a region of the mold copper plate 11, and the inside thereof illustrates a region of the molten steel 5 or the solidified shell 9. In the embodiment, the height direction of the mold 1 was divided with the same intervals of dz=50 [mm]. Moreover, the width and thickness directions of the mold 1 were divided with the intervals of 2 mm only in the region R2 where the growth of the solidified shell 9 is expected, and was divided in the center part of the molten steel 5 so that the intervals of calculation cells are variable in accordance with the width and the thickness of a cast slab while the number of meshes is fixed. Note that in the heat transfer phenomenon in the height direction of the mold 1, Peclet number Pe found by the following Expression (2) is $10^4$ order.

$$Pe = \frac{\rho u C_P}{\frac{k}{L}} \tag{2}$$

Here, L [m] in Expression (2) indicates a length of the mold 1. The Peclet number Pe is a dimensionless number indicating a ratio of convection and diffusion in heat movement. The larger Peclet number Pe indicates larger influence of convection in heat movement. That is, the contribution by a convention term is significantly larger than the contribution by heat conduction. Therefore, the heat conduction was not considered in the height direction of the mold 1, and it was presumed that the molten steel 5 is lowered at a casting speed. With this presumption, it is possible to reproduce the phenomenon of the three-dimensional transient heat transfer calculation model by vertically arranging two-dimensional transient heat transfer calculation. Then, the temperature of a calculation cell in the width and thickness directions of the mold 1 was calculated by discretizing the following Expression (3) of transient two-dimensional heat conduction equation.

$$\rho\frac{\partial(C_P T)}{\partial t} = \frac{\partial}{\partial x}\left(k\frac{\partial T}{\partial x}\right) + \frac{\partial}{\partial y}\left(k\frac{\partial T}{\partial y}\right) \tag{3}$$

Moreover, the temperature of cooling water $T_{water}$ was constant, and the boundary conditions on the interface between the mold copper plate 11 and cooling water were in accordance with the following Expression (4) of Newton's law of cooling using a heat transfer coefficient of water $h_{water}$.

$$-k\left(\frac{\partial T}{\partial x}\right) = h_{water}(T - T_{water}) \tag{4}$$

Figure 8:
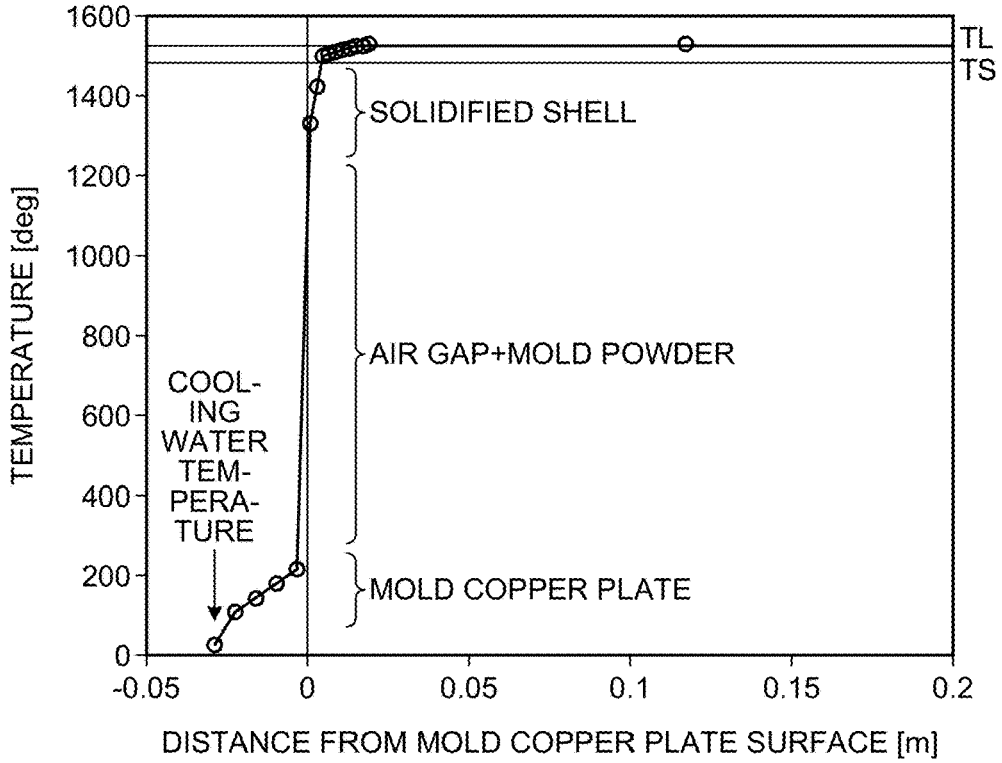
FIG. 8 is a diagram illustrating an example of the relation between the distance from a mold copper plate surface and the temperature.

FIG. 8 illustrates the relation between the temperature and the distance from the surface of the mold copper plate 11 that is obtained by calculating the two-dimensional transient heat conduction equation of Expression (3) until the state becomes normal. The liquidus temperature $T_L$ and the solidus temperature $T_s$ were obtained by a regression expression of steel type components and a temperature used in actual operations. The calculation cell having a temperature lower than the solidus temperature $T_s$ in the molten steel part was regarded as the solidified shell 9, and the solidified shell thickness was calculated. Moreover, the calculation cells in the molten steel part having a temperature higher than the liquidus temperature $T_L$ are stirred sufficiently, and thus the temperature was set to be uniform in each time step. In this manner, the process of Step S4 is completed, and the processing for estimating a solidified shell thickness in a mold shifts to the process of Step S5.

Figure 9:
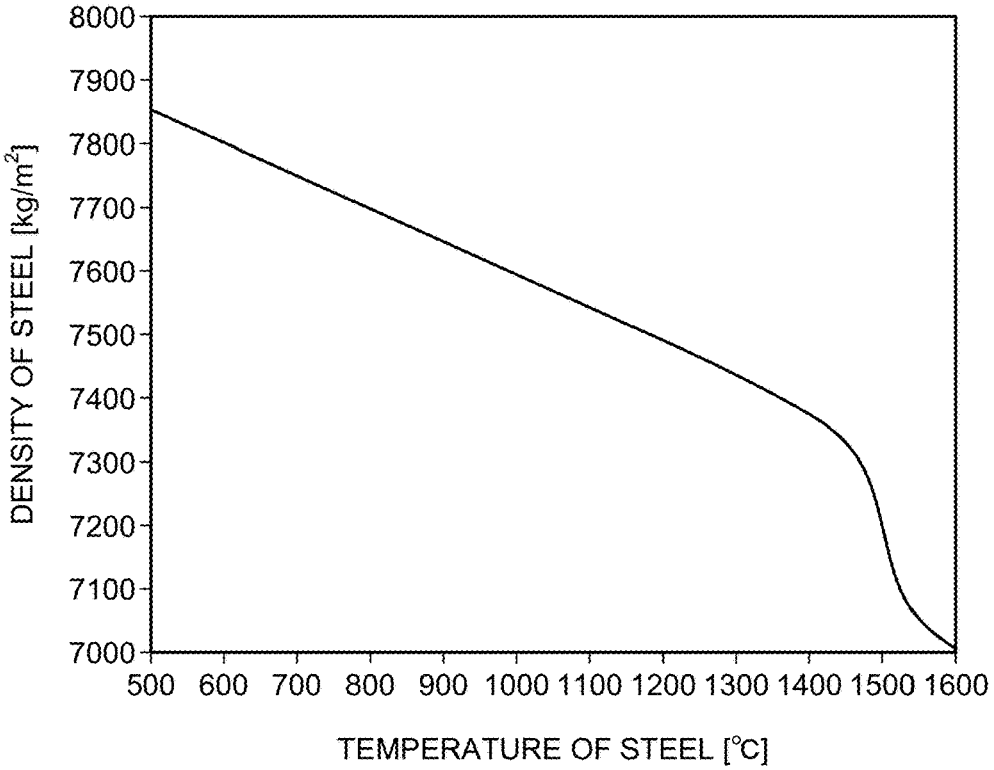
FIG. 9 is a diagram illustrating an example of the relation between the temperature of steel and the density thereof.

At the process of Step S5, the heat transfer model calculation unit 107 calculates a solidification shrinkage amount and a general heat transfer coefficient between the mold 1 and the solidified shell 9 using the information acquired at the process of Step S1 and Step S4 and the information of the model DB 103. In the mold 1, a taper is provided from the upper part toward the lower part considering solidification shrinkage. Because the solidification shrinkage amount exceeds the taper in the upper part of the mold 1, air referred to as an air gap existing between the solidified shell 9 and the mold copper plate 11 becomes thick. Meanwhile, in the lower part of the mold 1, the solidified shell growth speed gradually becomes slower, and the solidification shrinkage amount becomes smaller than the taper. Thus, an air gap may become small. The air gap has a large heat resistance, and has a great contribution to the mold heat reduction amount and the solidified shell thickness. Thus, it is important to reproduce the solidification shrinkage amount on a model. Therefore, the solidification shrinkage amount was calculated. First, the temperature dependency of the density of steel was set as illustrated in FIG. 9 (see Non Patent Literature 1), for example, and the shrinkage percentage $r_{shrink}$ of a solidified shell was defined as Expression (5).

$$r_{shrink} = \left(\frac{\rho_1}{\rho_0}\right)^{-\frac{1}{3}} \tag{5}$$

Here, in Expression (5), $\rho_0$ indicates the density of molten steel corresponding to a molten steel temperature immediately after discharge, and $\rho_1$ indicates the density of molten steel corresponding to an outer surface temperature of a solidified shell. The shrinkage percentage obtained for each calculation cell in the heat transfer model is multiplied by a width dx of each calculation cell, and a difference between the sum in the width direction and a cast slab width is calculated, whereby a solidification shrinkage amount is obtained. Furthermore, a taper $d_{taper}$ found by the following Expression (6) was deducted from the solidification shrinkage amount so as to calculate an air gap $d_{air}$ at each height position using the following Expression (7).

$$d_{taper} = \frac{C_1 w \Delta h}{100} \tag{6}$$

$$d_{air} = \left(w - \sum(r_{shrink} \times dx)\right) - d_{taper} \tag{7}$$

Here, in Expressions (6), (7), $C_1$ [%·m] indicates a taper rate, w [m] a cast slab width, and Δh [m] a distance in the height direction from a meniscus. Moreover, on the interface between the mold copper plate 11 and the solidified shell 9, there exists a layer of the mold powder 7 in addition to an air gap. Thus, a general heat transfer coefficient $h_{all}$ between the mold and the solidified shell considering a solidification shrinkage amount was calculated by the following Expression (8).

$$h_{al\ l} = A\exp(d_{air}/d_0) + B \tag{8}$$

Note that it is preferable that the parameters A, B, $d_0$ in Expression (8) are adjusted in accordance with actual data and preliminarily input in the model DB 103. In this manner, the process of Step S5 is completed, and the processing for estimating a solidified shell thickness in a mold shifts to the process of Step S6.

At the process of Step S6, the arithmetic processing unit 104 stores the calculation result in the model DB 103 and the output device 108. In this manner, the process of Step S6 is completed, and the processing for estimating a solidified shell thickness in a mold shifts to the process of Step S7.

At the process of Step S7, the arithmetic processing unit 104 determines whether the casting is completed. As a result of determination, when the casting is completed (Yes at Step S7), the arithmetic processing unit 104 finishes a series of processing for estimating a solidified shell thickness in a mold. Meanwhile, when the casting is not completed (No at Step S7), the arithmetic processing unit 104 updates a time step, and returns the processing for estimating a solidified shell thickness in a mold to the process of Step S1.

As is clear from the above description, in the method for estimating a solidified shell thickness in a mold according to an embodiment of the present invention, the conversion unit 106 converts a molten steel flow rate in the mold 1 into a heat conductivity, and the heat transfer model calculation unit 107 solves a three-dimensional transient heat conduction equation using the conductivity calculated by the conversion unit 106, so as to calculate the temperature distribution of the mold 1 and the steel in the mold 1 to estimate a solidified shell thickness in the mold. Therefore, it is possible to estimate, with high accuracy, a solidified shell thickness in the mold 1 including the width direction and the thickness direction of the mold 1.

Embodiment

Figure 10:
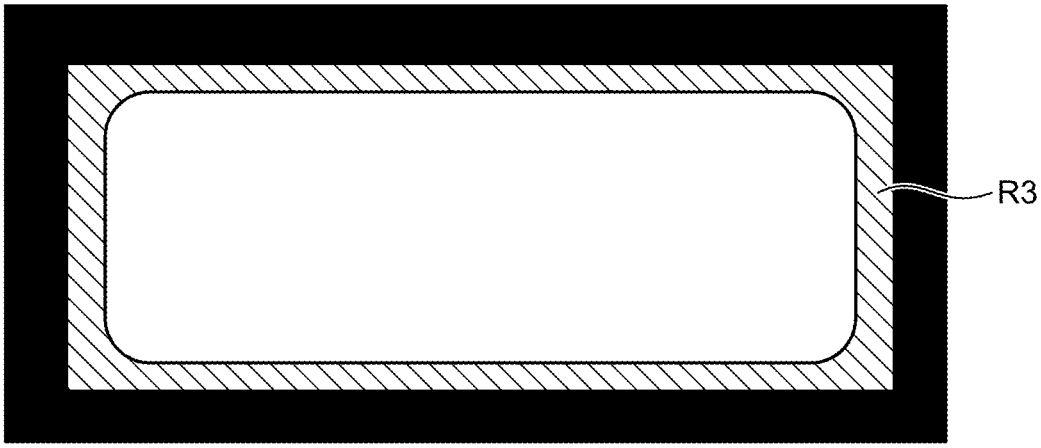
FIG. 10 is a diagram illustrating an example of the solidified shell thickness distribution obtained when a three-dimensional transient heat transfer calculation model is calculated without using a molten steel flow distribution as an input condition.
Figure 11:
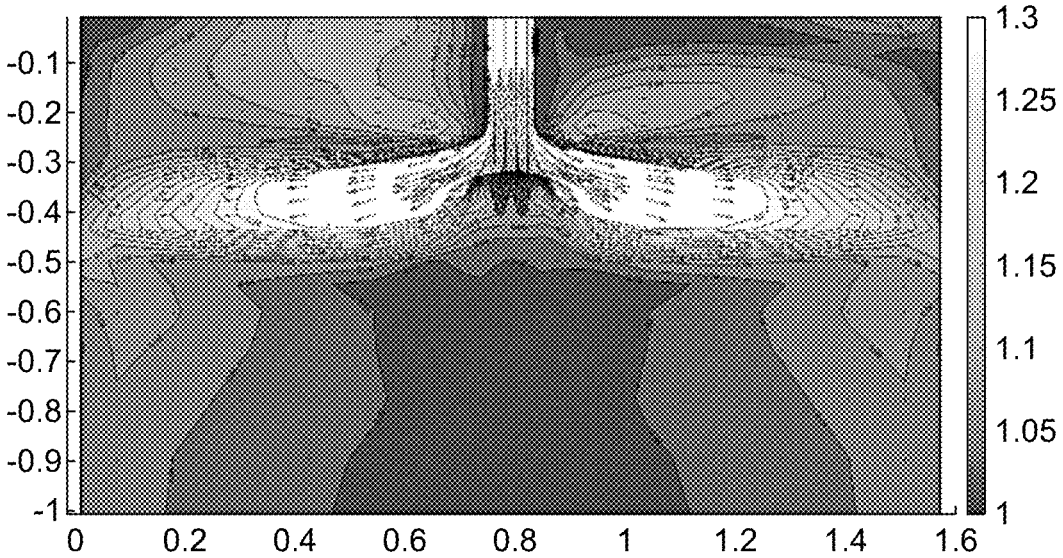
FIG. 11 is a diagram illustrating an example of the three-dimensional molten steel flow distribution in a mold.
Figure 12:
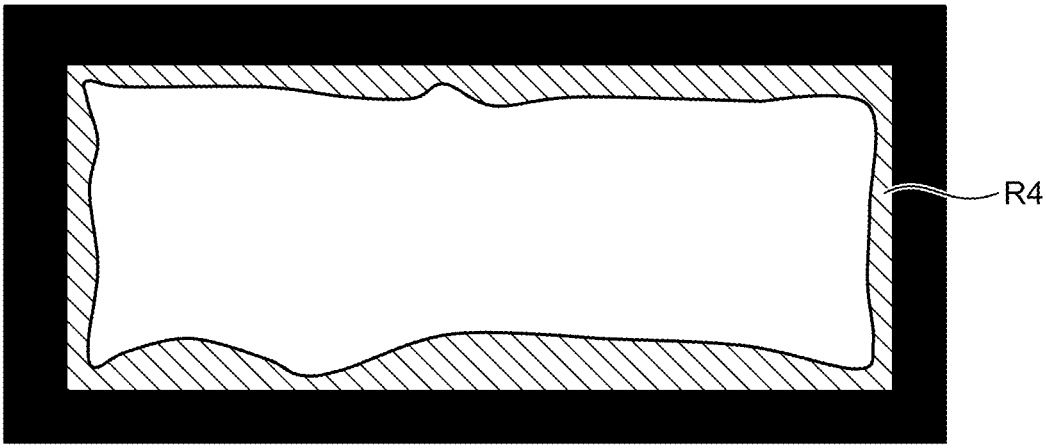
FIG. 12 is a diagram illustrating an example of the solidified shell thickness distribution obtained when a three-dimensional transient heat transfer calculation model is calculated using a three-dimensional molten steel flow distribution in a mold as an input condition.

When the three-dimensional transient heat transfer calculation model was calculated without using the molten steel flow distribution as an input condition, there was obtained the solidified shell thickness distribution almost uniform in the width direction and the thickness direction of the mold, as illustrated in the oblique line region R3 of FIG. 10. Meanwhile, when the three-dimensional transient heat transfer calculation model was calculated adding, as an input condition, the three-dimensional molten steel flow distribution in the mold as illustrated in FIG. 11, which is obtained by the method for estimating a molten steel flow state described in Patent Literature 2, there was obtained the solidified shell thickness distribution varied in the width direction and the thickness direction in the mold as illustrated in the oblique line region R4 of FIG. 12. Therefore, it was confirmed that in the present invention, it is possible, with high accuracy, to estimate a solidified shell thickness in the mold 1 including the width direction and the thickness direction of the mold 1.

The above has described the embodiment to which the present invention made by the present inventors is applied. However, the description and the drawings forming a part of the disclosure of the present invention by the embodiment do not limit the present invention. For example, if the measurement information related to a mold copper plate temperature and a mold heat reduction amount is obtained, the correction calculation processing for correcting unknown disturbances is applied into heat transfer model calculation, whereby the further improvement in accuracy of solidified shell thickness distribution estimation is expected. In this manner, other embodiments, examples, operation techniques, and the like made by those skilled in the art based on this embodiment are all included in the scope of the present invention.

INDUSTRIAL APPLICABILITY

In the present invention, it is possible to provide a device for estimating a solidified shell thickness in a mold and a method for estimating a solidified shell thickness in a mold that are capable of estimating, with high accuracy, a solidified shell thickness in a mold including the width direction and the thickness direction of the mold.

REFERENCE SIGNS LIST

1 mold
3 immersion nozzle
5 molten steel
7 mold powder
9 solidified shell
11 mold copper plate
100 device for estimating a solidified shell thickness in a mold
101 control terminal
102 input device
103 model database (model DB)
104 arithmetic processing unit
106 conversion unit
107 heat transfer model calculation unit
108 output device
110 display device
201 cooling water
202 semi-solidified region
203 molten steel flow rate
204 mold heat reduction amount

The invention claimed is:

1. A device comprising:

an input device configured to receive an input of measurement results of a temperature and components of molten steel in a tundish of continuous casting facilities, measurement results of a width, a thickness, and a casting speed of a cast slab casted in the continuous casting facilities, and molten steel flow rate distribution in a mold;

a model database configured to store a model expression and a parameter related to solidification reaction of molten steel in the mold of the continuous casting facilities;

a convertor configured to convert a molten steel flow rate in the mold input to the input device into a heat conductivity parameter; and a calculator configured to estimate a solidified shell thickness in the mold based on temperature distribution of the mold and steel in the mold calculated by solving a three-dimensional transient heat conduction equation using the measurement results of a temperature and components of molten steel in the tundish of the continuous casting facilities, the measurement results of a width, a thickness, and a casting speed of a cast slab casted in the continuous casting facilities, the model expression, the parameter, and the heat conductivity parameter converted by the convertor.

2. The device according to claim 1, wherein the convertor is configured to convert a molten steel flow rate in a region having a temperature higher than a solidus temperature of molten steel and lower than a liquidus temperature of molten steel into a heat conductivity parameter.

3. The device according to claim 2, wherein the calculator is configured to:

calculate a solidification shrinkage amount of molten steel based on temperature distribution of steel in the mold, and calculate a general heat transfer coefficient between the mold and the solidified shell based on the solidification shrinkage amount.

4. The device according to claim 3, wherein the calculator is configured to perform three-dimensional transient heat transfer calculation by vertically arranging two-dimensional transient heat transfer calculation models divided in a height direction of the mold.

5. The device according to claim 2, wherein the calculator is configured to perform three-dimensional transient heat transfer calculation by vertically arranging two-dimensional transient heat transfer calculation models divided in a height direction of the mold.

6. The device according to claim 1, wherein the calculator is configured to:

calculate a solidification shrinkage amount of molten steel based on temperature distribution of steel in the mold, and calculate a general heat transfer coefficient between the mold and the solidified shell based on the solidification shrinkage amount.

7. The device according to claim 6, wherein the calculator is configured to perform three-dimensional transient heat transfer calculation by vertically arranging two-dimensional transient heat transfer calculation models divided in a height direction of the mold.

8. The device according to claim 1, wherein the calculator is configured to perform three-dimensional transient heat transfer calculation by vertically arranging two-dimensional transient heat transfer calculation models divided in a height direction of the mold.

9. A method comprising:

inputting measurement results of a temperature and components of molten steel in a tundish of continuous casting facilities, measurement results of a width, a thickness, and a casting speed of a cast slab casted in the continuous casting facilities, and molten steel flow rate distribution in a mold;

converting a molten steel flow rate in the mold input at the inputting into a heat conductivity parameter; and estimating a solidified shell thickness in the mold based on temperature distribution of the mold and steel in the mold calculated by solving a three-dimensional transient heat conduction equation using the measurement results of a temperature and components of molten steel in the tundish of the continuous casting facilities, the measurement results of a width, a thickness, and a casting speed of a cast slab casted in the continuous casting facilities, a model expression and a parameter related to solidification reaction of the molten steel in the mold of the continuous casting facilities, and the heat conductivity parameter converted at the converting.

10. The method according to claim 9, wherein the converting includes converting a molten steel flow rate in a region having a temperature higher than a solidus temperature of molten steel and lower than a liquidus temperature of molten steel into a heat conductivity parameter.

11. The method according to claim 10, wherein the calculating includes:

calculating a solidification shrinkage amount of molten steel based on temperature distribution of steel in the mold, and calculating a general heat transfer coefficient between the mold and the solidified shell based on the solidification shrinkage amount.

12. The method according to claim 11, wherein the calculating includes performing three-dimensional transient heat transfer calculation by vertically arranging two-dimensional transient heat transfer calculation models divided in a height direction of the mold.

13. The method according to claim 10, wherein the calculating includes performing three-dimensional transient heat transfer calculation by vertically arranging two-dimensional transient heat transfer calculation models divided in a height direction of the mold.

14. The method according to claim 9, wherein the calculating includes:

calculating a solidification shrinkage amount of molten steel based on temperature distribution of steel in the mold, and calculating a general heat transfer coefficient between the mold and the solidified shell based on the solidification shrinkage amount.

15. The method according to claim 14, wherein the calculating includes performing three-dimensional transient heat transfer calculation by vertically arranging two-dimensional transient heat transfer calculation models divided in a height direction of the mold.

16. The method according to claim 9, wherein the calculating includes performing three-dimensional transient heat transfer calculation by vertically arranging two-dimensional transient heat transfer calculation models divided in a height direction of the mold.

* * * * *